US007219401B2

(12) United States Patent
Yamagishi et al.

(10) Patent No.: US 7,219,401 B2
(45) Date of Patent: May 22, 2007

(54) SLIDER FOR SLIDE FASTENER WITH AUTOMATIC STOPPER

(75) Inventors: Koji Yamagishi, Toyama-ken (JP); Keiichi Keyaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 49 days.

(21) Appl. No.: 11/012,816

(22) Filed: Dec. 14, 2004

(65) Prior Publication Data

US 2005/0125967 A1 Jun. 16, 2005

(30) Foreign Application Priority Data

Dec. 16, 2003 (JP) ..... 2003-418167

(51) Int. Cl.
*A44B 19/30* (2006.01)

(52) U.S. Cl. ..... 24/421

(58) Field of Classification Search ..... 24/420–425, 24/418

See application file for complete search history.

(56) References Cited

U.S. PATENT DOCUMENTS 3,320,645 A * 5/1967 Burbank ..... 24/421
4,768,263 A * 9/1988 Fukuroi et al. ..... 24/418
4,980,954 A * 1/1991 Takabatake et al. ..... 24/421

FOREIGN PATENT DOCUMENTS

DE 2332013 A * 1/1975
GB 1377451 A * 12/1974
JP 2002-10808 1/2002

* cited by examiner

*Primary Examiner*—James R. Brittain
(74) *Attorney, Agent, or Firm*—Everest Intellectual Property Law Group; Michael S. Leonard

(57) ABSTRACT

A slider having an automatic stopper capable of accommodating a drooping piece of a leaf spring in a front face of a guide post of the slider and protecting it. In a body of the slider, upper and lower blades are connected via the guide post, and a groove portion which is open continuously in a vertical direction is provided at the front face of the guide post is provided. The drooping piece formed by bending an end of the leaf spring of an automatic stop mechanism disposed on a top face of the upper blade is engaged and accommodated within the groove portion and a projecting portion projecting forward is provided at a bottom end of the groove portion. The projecting portion is located below the drooping piece to protect a front end of the drooping piece and formed into a shape preventing a pointed object from being inserted between the drooping piece and the projecting portion, thereby protecting the slider from being destroyed intentionally.

3 Claims, 4 Drawing Sheets

SLIDER FOR SLIDE FASTENER WITH AUTOMATIC STOPPER

BACKGROUND OF THE INVENTION

1. Field of the Invention

The present invention relates to a slider for a slide fastener with an automatic stopper in which a stop function thereof is activated when a leaf spring having a locking pawl is operated by raising or laying a pull.

2. Description of Related Art

A conventionally known slider for a slide fastener with an automatic stopper of this type, for example, disclosed in Japanese Patent Application Laid-Open No. 2002-10808 shown in FIG. 6, comprises a projecting piece 26' provided at a rear of an upper blade 4' of a body 1', a pawl hole 20' provided at a proximal portion thereof, a projecting piece 12' provided at a front of the upper blade 4' and a contact portion 14', with which an engaging tongue piece 24' of a leaf spring 2' makes contact, provided in the projecting piece 12'. A groove portion 21' having an engaging portion is provided in a front face of a guide post 6', and the leaf spring 2' has a fallen C shape while a locking pawl 8' is provided on an end of the leaf spring 2' and a drooping piece 9' is provided on the other end. The drooping piece 9' is provided with an engaging piece which is engaged with the engaging portion, and the engaging tongue piece 24' is provided at a center of the leaf spring 2' with being bent. The leaf spring 2' is engaged with the projecting piece 26' at the rear of the upper blade 4' and the engaging portion of the guide post 6', so that the engaging tongue piece 24' is always in a pressure contact state with the contact portion 14'.

In the slider with the automatic stopper shown in FIG. 6, the drooping piece 9' of the leaf spring 2' is accommodated within the groove portion 21' formed in the front face of the guide post 6' and engaged therein. However, because the front end of the drooping piece 9' accommodated and engaged in the groove portion 21' is exposed outside, there is a fear that it may catch a fabric of clothing and damage the fabric. Further, there is another fear that the drooping piece 9' may slip out of the engaging portion. Moreover, there is a fear that a tool having a pointed tip such as an eyeleteer may be inserted in between the front end of the drooping piece 9' and the groove portion 21', so as to intentionally destroy the mechanism.

SUMMARY OF THE INVENTION

The present invention has been achieved in views of the above-described problem and a main object of the present invention is to provide a slider for a slide fastener with an automatic stopper having an safety automatic stopping mechanism which prevents a front end of a drooping piece accommodated and engaged within a groove portion in a guide post from moving downward and projecting to make contact with another object and slip out of an engaging portion and prevents a pointed object from being inserted in between the drooping piece and the groove portion.

Another object of the present invention is to provide a slider for a slide fastener with an automatic stopper which protects the front end of the drooping piece by specifying the shape of the projecting portion disposed in the groove portion in the guide post, thereby exerting an excellent protecting performance.

To achieve the above-described object, according to the main aspect of the present invention, there is provided a slider for a slide fastener with an automatic stopper, in which a groove portion, a groove portion, which is open continuously in a vertical direction, is provided in a front face of a guide post for connecting an upper blade and lower blade; a drooping piece of a leaf spring in a stop mechanism disposed on a top face of the upper blade is accommodated within the groove portion and engaged in the groove portion; a projecting portion projecting forward is provided in the groove portion; and the projecting portion is so shaped to be located below a front end of the drooping piece. Consequently, the front end of the drooping piece is prevented from moving downward and a degree of exposure of the front end of the drooping piece is reduced so as to reduce the opportunity of contact with another object thereby eliminating a danger of making damage on another object and preventing the slider itself from being destroyed. Additionally, a slider having a safety automatic mechanism, which prevents any pointed object from being inserted in between the drooping piece and the groove portion, can be finished.

Preferably, the projecting portion projects forward at least compared with an inner edge of the front end of the drooping piece. Consequently, the projecting portion formed in the groove portion protects the front end of the drooping piece accurately.

Further preferably, a bottom face of the projecting portion extends so as to agree with a surface of the lower blade of the body. Consequently, from viewpoints of an appearance of the slider, the degree of exposure of the groove portion and engaging portion decreases due to an existence of the projecting portion, so that the slider having a beautiful appearance is finished.

Preferably, a top face of the projecting portion tilts downward from a proximal portion of the projecting portion to a front end portion of the projecting portion. Consequently, an accommodation space for the drooping piece is secured in the groove portion, so that the drooping piece is maintained in a stable condition.

Further, it is preferable that a front end of the projecting portion exists within the groove portion without protruding outwardly from the groove portion. Consequently, because the groove portion exists within the groove portion, the front end of the drooping piece can be protected securely without any contact with another object. That is, the effects which the present invention exerts are considerably remarkable.

DESCRIPTION OF THE PREFERRED EMBODIMENTS

Figure 1:
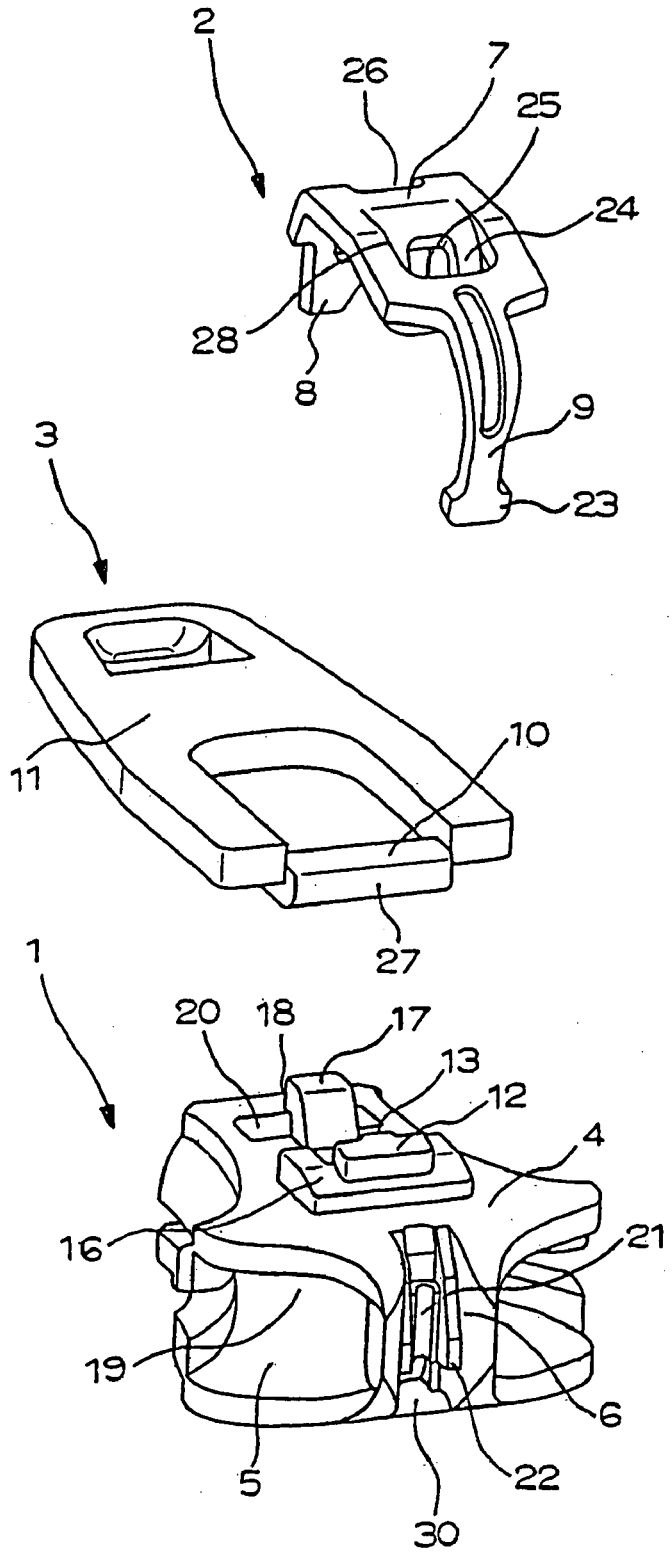
FIG. 1 is an exploded perspective view of a slider for a slide fastener with an automatic stopper.
Figure 2:
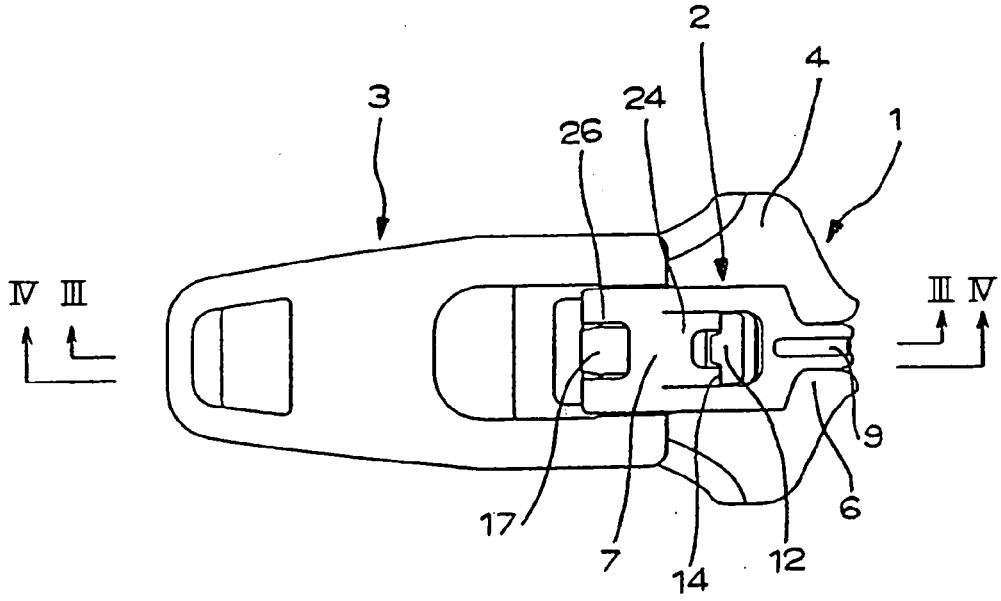
FIG. 2 is a front view of the slider.
Figure 3:
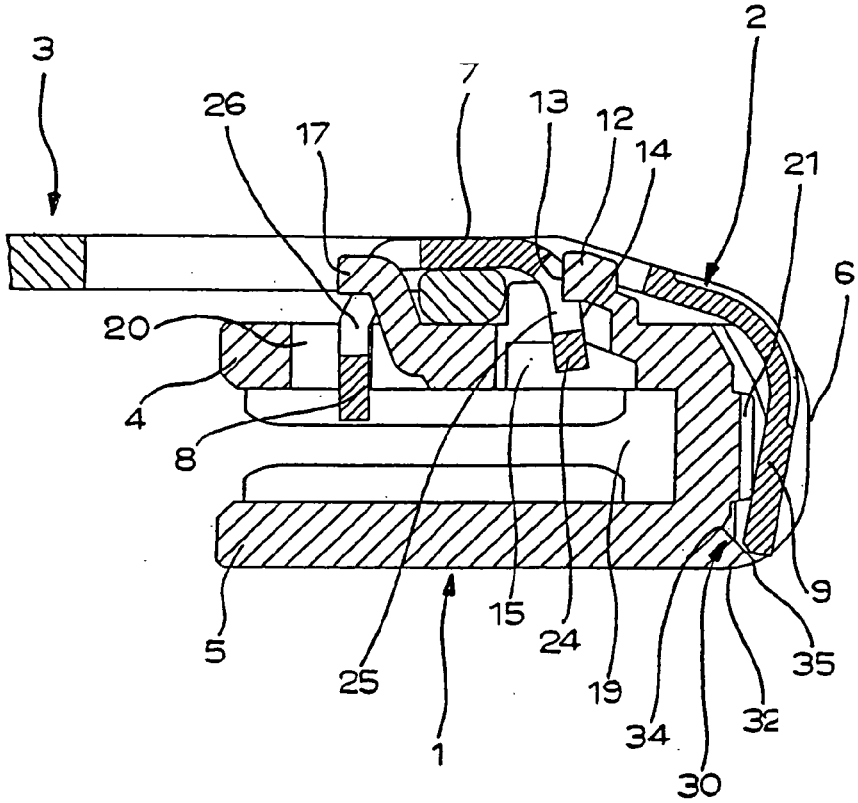
FIG. 3 is a sectional view taken along a line III—III of the slider.
Figure 4:
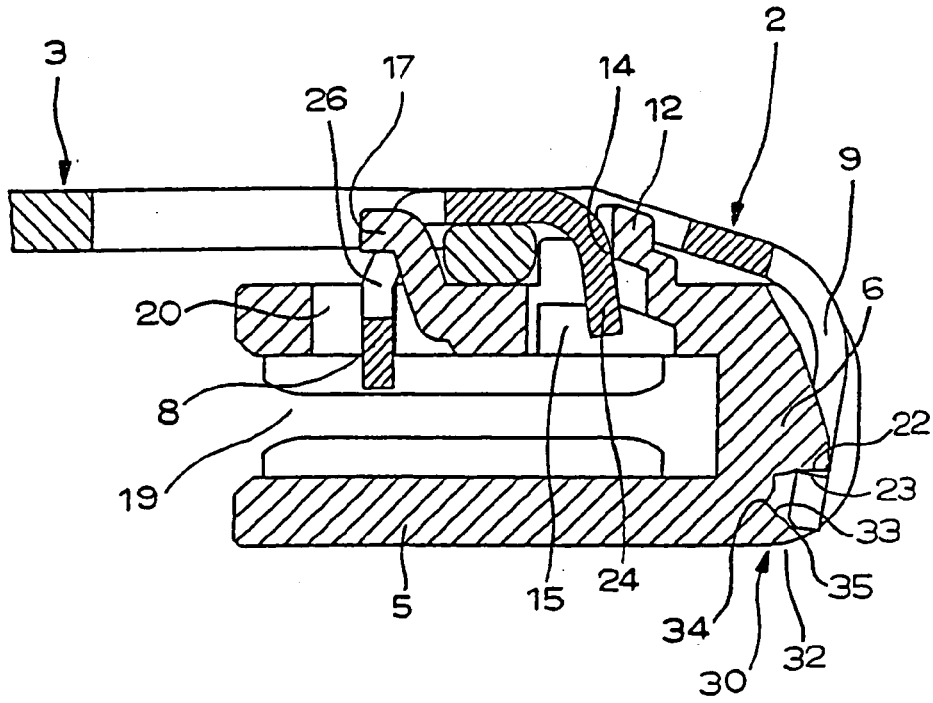
FIG. 4 is a sectional view taken along a line IV—IV of the slider.
Figure 5:
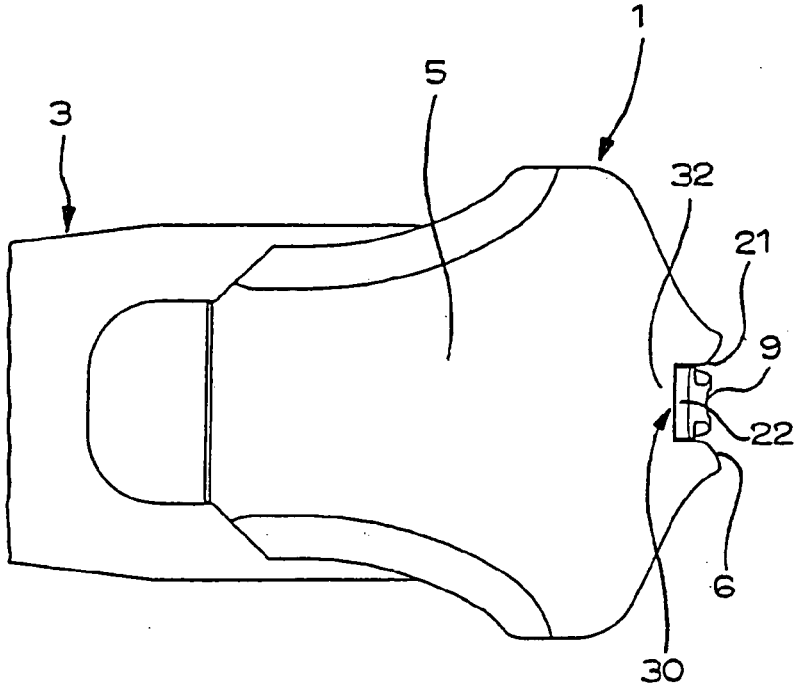
FIG. 5 is a rear view of the slider.
Figure 6:
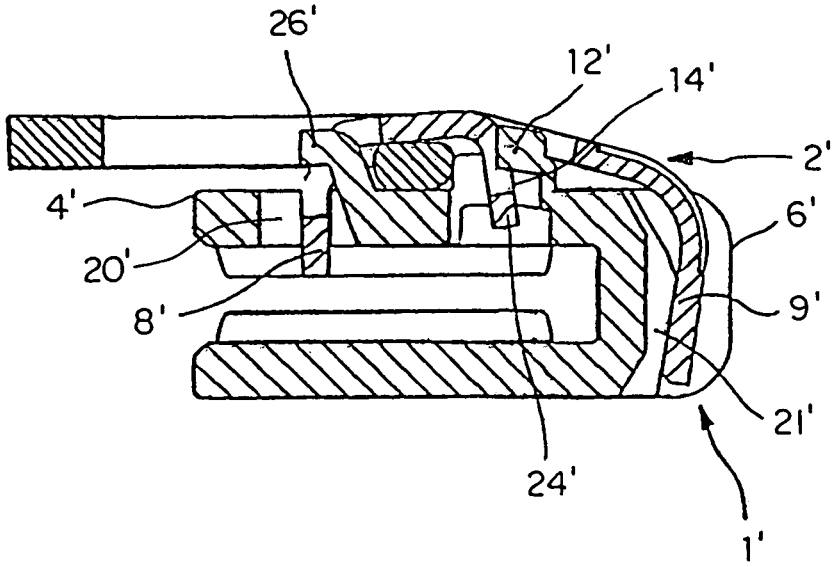
FIG. 6 PRIOR ART
FIG. 6 is a longitudinal sectional view of a well known slider.

In a slider for a slide fastener with an automatic stopper of the present invention, an upper blade 4 and a lower blade 5 of a body 1 of the slider are connected via a guide post 6, and a projecting piece 17 is provided at a rear of the upper blade 4. A pawl hole 20 is provided at a proximal portion of the projecting piece and a projecting piece 12 is provided at a front of the upper blade 4. A contact portion 14, with which an engaging tongue piece 24 of a leaf spring 2 makes contact, is provided in the projecting piece 12, and a groove portion 21 having engaging portions 22 is provided in a front face of the guide post 6. The leaf spring 2 has a fallen C shape, while a locking pawl 8 is provided at an end of the leaf spring and a drooping piece 9 is provided at the other end. An engaging piece 23 which engages the engaging portions 22 is provided on the drooping piece 9 and the engaging tongue piece 24 is provided in a center of the leaf spring 2 such that it is bent downward. The leaf spring 2 is engaged with the projecting piece 17 at the rear of the upper blade and the engaging portions 22 of the guide post 6 so that the engaging tongue piece 24 is always kept in a pressure contact with the contact portion 14. A projecting portion 30 projecting in the groove portion 21 is provided below the front end of the drooping piece 9 accommodated and engaged within the groove portion 21 so as to hold the front end of the drooping piece 9.

A preferred embodiment of the slider for the slide fastener with the automatic stopper of the present invention will be described with reference to the accompanying drawings.

The slider for the slide fastener with the automatic stopper of the invention comprises three members, a body 1, a leaf spring 2 and a pull 3, and these members are manufactured by pressing a metal such as copper-zinc alloy. The body 1 connects the upper blade 4 and the lower blade 5 via the guide post 6 and a guide groove 19 for fastener elements is formed internally. The leaf spring 2 is a sheet-like member and both ends thereof are bent, such that a base plate 7 is formed in a center of the leaf spring, a locking pawl 8 is formed on an end thereof and the drooping piece 9 for fixing this leaf spring 2 to the body 1 is formed on the other end. In the pull 3, a pintle 10 which is fixed pivotally on the body 1 is provided at an end thereof while a grip portion 11 is formed at the other end.

In the body 1, a projecting piece 12 projecting upward in the shape of a hook is provided in a center on a shoulder side of the upper blade 4, and an engaging protrusion 13 which projects is provided in a center of a front end of the projecting piece 12 and a through hole 25 in an engaging tongue piece 24 of the leaf spring 2 meets the protrusion 13. A contact portion 14 is formed in which the engaging tongue piece 24 can make contact with the front end of the projecting piece 12 on both sides of the engaging protrusion 13. The contact portion 14 is formed in a vertical plane whose extension intersects the top face of the upper blade 4 at right angle. A through hole 15 communicating with an element guide groove 19 is provided at a proximal portion of the projecting piece 12 and a supporting base 16, which is inclined forward, is provided protrudedly on both sides of the proximal portion of the projecting piece 12. The supporting base 16 makes contact with a bottom face of the leaf spring 2 when a pressing force is applied to the leaf spring from above, so that the leaf spring 2 is prevented from being deformed plastically due to its excessive deformation.

A hook-like projecting piece 17 tilting backward is provided protrudedly in a center on the rear mouth side of the upper blade 4, and an engaging portion 18 is provided by bending a front end of the projecting piece 17 and then fitted into a hooking hole 26 of the leaf spring 2 such that the engaging portion moves freely. A pawl hole 20, which communicates with the element guide groove 19, is provided at a proximal portion of the projecting piece 17. A groove portion 21 is provided in the front face of the guide post 6, and substantially right-angled triangular engaging portions 22, whose bottom portions are horizontal and whose upper portions are tilted, are provided on both sides of this groove portion 21 and are capable of being engaged with an engaging piece 23 of the leaf spring 2.

The groove portion 21 formed in the front face of the guide post 6 is provided with a projecting portion 30 projecting forward at the bottom end of the guide post. This projecting portion 30 projects forward at least compared with an inner edge at the front end of the drooping piece 9 of the leaf spring 2 accommodated and engaged in the groove portion 21 so as to hold the drooping piece 9. A bottom face 32 of the projecting portion 30 extends so as to agree with the surface of the lower blade 5, thereby contributing the smooth sliding of the slider. A top face 33 of this projecting portion 30 is inclined downward toward a front end portion 35 from a proximal portion 34 of the projecting portion, and the front end portion 35 of the projecting portion 30 is located within the groove portion 21 so as to protect the front end of the drooping piece 9 of the leaf spring 2 accommodated and engaged in the groove portion 21.

The leaf spring 2 is formed in a substantially fallen C shape while the locking pawl 8 is provided at an end of the leaf spring and a narrow drooping piece 9 is provided at the other end. The engaging piece 23 stretched sideways is provided at the front end of the drooping piece 9 and is engaged with the engaging portions 22 provided on the guide post 6. An opening portion 28 is provided in the central base plate 7 of the leaf spring 2 and the engaging tongue piece 24 extending so as to be bent downward and forward from a mouth edge of the opening portion 28 is provided. The through hole 25 is provided in a center of this engaging tongue piece 24 and the engaging protrusion 13 is fitted into the through hole such that it is capable of moving freely. The hooking hole 26, to which the engaging portion 18 of the projecting piece 17 located at rear of the upper blade can be fitted freely movably, is provided in the leaf spring 2 in the vicinity of the locking pawl 8, thereby preventing the locking pawl 8 from floating upward.

The pull 3 is provided with a pintle 10 at an end of the pull and the grip portion 11 at the other end. When the pull 3 is mounted on the body 1 and fallen, the pintle 10 projects eccentrically to a side opposed to the body 1, and a cam 27, wherein a sectional shape of the pintle 10 presents a rectangular shape extending along the length direction of the pull 3, is formed, so that the pull 3 is mounted on the body 1 and the leaf spring 2 is brought up when the pull 3 is raised or fallen.

As for the assembly of the slider having the automatic stop mechanism, the pull 3 is placed such that the cam 27 provided on the pintle 10 of the pull 3 is accommodated between the front and rear projecting pieces 12 and 17 on the upper blade 4 of the body 1, and the leaf spring 2 is disposed on the top face of the pull or the locking pawl 8 is inserted into the pawl hole 20 in the upper blade 4. At the same time, while the projecting piece 17 is fitted in the hooking hole 26 with some play, the mouth edge of the hooking hole 26 is engaged with the engaging portion 18 of the projecting piece 17.

The projecting piece 12 is inserted and fitted in the opening portion 28 provided in the front portion of the base plate 7 of the leaf spring 2, and the engaging tongue piece 24 of the leaf spring 2 is inserted into the through hole 15 provided below the projecting piece 12. The engaging protrusion 13 of the projecting piece 12 is fitted to the through hole 25 in the engaging tongue piece 24, and the side edges of the leaf spring 2 are placed on the supporting base 16 on the upper blade 4 such that the surface of the engaging tongue piece 24 is brought into a pressure contact with the contact portion 14 provided on the projecting piece 12.

If the drooping piece 9 provided at the front end of the leaf spring 2 is pressed down while the front end of the drooping piece is guided along the slope of the engaging portions 22 disposed on both sides of the concave groove portion 21 provided in the guide post 6 of the body 1, the drooping piece 9 is deformed elastically and when surpassing the slopes on the top of the engaging portions 22, restored elastically, so that the drooping piece 9 invades into a gap between the horizontal faces on the bottoms of the engaging portions 22 and the top face of the projecting portion 30. Consequently, the engaging piece 23 is engaged with the engaging portions 22 and further, the drooping piece 9 makes a firm contact with the bottom face of the groove portion 21, thereby completing the assembly of the slider.

In the assembled slider, if the pull 3 is erected on the body 1, the leaf spring 2 is raised by the cam 27 of the pull 3 against an elastic force so as to retreat the locking pawl 8 from the element guide groove 19, thereby making it possible to slide the slider freely. If the pull 3 is fallen to its original position, the locking pawl 8 advances into the element guide groove 19 and is inserted in between the elements, thereby stopping the slider. Because if the pull 3 is fallen forward of the body 1, the leaf spring 2 is brought up by the cam 27 formed eccentrically and maintained in that condition, so that the slider can be slide forward freely.

As for the application of the slider for the slide fastener with the automatic stopper of the present invention, this slider is mounted on an opening portion of the front part of clothes such as various kinds of coats and jumpers. The slider can be slide to its distal end to close the opening portion or can be automatically stopped from sliding halfway, so that the opening portion is in a half opening state.

What is claimed is:

1. A slider for a slide fastener with an automatic stopper, wherein a groove portion, which is open continuously in a vertical direction and outwardly away from the slider, is provided in a front face of a guide post for connecting an upper blade and a lower blade; a drooping piece of a leaf spring in a stop mechanism disposed on a top face of the upper blade is accommodated within the groove portion and engaged therein; a projecting portion projecting forward is provided in the groove portion; the projecting portion is so shaped to be located below a front end of the drooping piece; the projecting portion having a proximal portion at the guide post and a front end portion away from the guide post; a top face of the projecting portion tilts downward away from the guide post from the proximal portion of the projecting portion to the front end portion of the projecting portion; and the front end portion of the projecting portion exists within the groove portion.

2. The slider for the slide fastener with the automatic stopper according to claim 1, wherein the projecting portion projects forward at least compared with an inner edge of the front end of the drooping piece.

3. The slider for the slide fastener with the automatic stopper according to claim 1, wherein a bottom face of the projecting portion extends so as to form a smooth surface with a surface of the lower blade.

* * * * *